US006299164B1

(12) United States Patent
Yi

(10) Patent No.: US 6,299,164 B1
(45) Date of Patent: Oct. 9, 2001

(54) FLOATING/DROPPING BALL GAME TABLE STRUCTURE

(76) Inventor: Chen Yung Yi, 7Fl., No. 94, Zhong Hsing St., Yong Ho City, Taipei (TW)

( * ) Notice: Subject to any disclaimer, the term of this patent is extended or adjusted under 35 U.S.C. 154(b) by 0 days.

(21) Appl. No.: 09/644,833

(22) Filed: Aug. 24, 2000

(51) Int. Cl.[7] ..... A63F 7/07

(52) U.S. Cl. ..... 273/126 A; 273/118 A; 273/119 A; 273/121 A; 273/122 A

(58) Field of Search ..... 273/118 R, 118 A, 273/119 R, 119 A, 121 R, 121 A, 122 R, 122 A, 123 R, 123 A, 124 R, 124 A, 125 R, 125 A, 126 R, 126 A, 127 R, 127 C

(56) References Cited

U.S. PATENT DOCUMENTS

| | | | | |
|---|---|---|---|---|
| 5,014,988 | * | 5/1991 | Mirando et la. | 273/125 A |
| 5,110,128 | * | 5/1992 | Robbins | 273/126 A |
| 5,161,801 | * | 11/1992 | Kazuk | 273/126 A |
| 5,222,737 | * | 6/1993 | Kazuk | 273/126 A |
| 5,556,093 | * | 9/1996 | Lankiewicz et al. | 273/126 A |

FOREIGN PATENT DOCUMENTS

| | | | | |
|---|---|---|---|---|
| 2322682 | * | 11/1974 | (DE) | 273/126 R |
| 2435268 | * | 5/1980 | (FR) | 273/119 A |

* cited by examiner

*Primary Examiner*—Raleigh W. Chiu
(74) *Attorney, Agent, or Firm*—Bacon & Thomas, PLLC

(57) ABSTRACT

Floating/dropping ball game table structure including a ball game table and a seat compartment. The ball game table includes a serve section, a lane section and a pocket section. A starting point is disposed on the serve section for the floating/dropping ball to rest thereon. A cavity is formed under the starting point for a player to take out an automatically returned ball. The lane section has a surface on which multiple 45 degrees inclined fine vents are evenly distributed. Several fans are arranged in a close space of the bottom of the lane section to provide necessary air floating force for the floating/dropping ball to slide over the lane section. A groove is formed on an adjoining section between the lane section and the pocket section. The pocket section has multiple independently partitioned dropping holes, multiple flickering devices and number flickering devices respectively corresponding to the dropping holes and scorers. The seat compartment includes two seats and a table face. A cabinet for placing personal stuffs therein is provided under each seat. A garbage can is disposed under the table face. A control panel having multiple functional push buttons is disposed above the table face to provide functions of random selection of the dropping holes, scoring, clearing, etc. The ball game table can be used in cooperation with a club and a floating/dropping ball in accordance with different game rules to achieve effects of leisure and entertainment.

3 Claims, 6 Drawing Sheets

FLOATING/DROPPING BALL GAME TABLE STRUCTURE

BACKGROUND OF THE INVENTION

The present invention relates to a ball game table structure, and more particularly to a floating/dropping ball game table structure which has leisurely and fashionable design and is combined with current electronic equipment. The ball game table can be used in accordance with different funny game rules to achieve leisure and entertainment effects.

All the busy workers in modern society need suitable leisurely activities for relaxing the mood and relieving the pressure.

There are many kinds of existent indoor and outdoor leisurely ball games which are very popular. Such ball games necessitate a long term of practice before skilled in these fields. These ball games have fixed playing rules which can be hardly changed. Therefore, some players may lose their interest in these games after a long period of playing.

SUMMARY OF THE INVENTION

It is therefore a primary object of the present invention to provide a novel floating/dropping ball game table structure which is a combination of various kinds of ball games such as golf, billiards, bowling, etc. The floating/dropping ball game table has thoughtful seat compartment design and dynamic and stimulating air floating device and fashionable electronic video and audio effect to achieve enhanced leisure and entertainment effects.

According to the above object, the floating/dropping ball game table structure of the present invention includes a ball game table and a seat compartment. The ball game table includes a serve section, a lane section and a pocket section. A starting point is disposed on the serve section for the floating/dropping ball to rest thereon. A cavity is formed under the starting point for a player to take out an automatically returned ball. The lane section has a polished plane surface on which multiple 45 degrees inclined fine vents are evenly distributed. Several fans are arranged in a close space of the bottom of the lane section to provide necessary air floating force for the floating/dropping ball to slide over the lane section. A groove is formed on an adjoining section between the lane section and the pocket section. The pocket section has multiple independently partitioned dropping holes, multiple flickering devices and number flickering devices respectively corresponding to the dropping holes and scorers. The seat compartment includes two seats and a table face. A cabinet for placing personal stuffs therein is provided under each seat. A garbage can is disposed under the table face. A control panel having multiple functional push buttons is disposed above the table face to provide functions of random selection of the dropping holes, scoring, clearing, etc. The ball game table can be used in cooperation with a club and a floating/dropping ball in accordance with different game rules to achieve effects of leisure and entertainment.

The present invention can be best understood through the following description and accompanying drawings wherein:

DETAILED DESCRIPTION OF THE PREFERRED EMBODIMENTS

Please refer to FIGS. 1 to 4. The floating/dropping ball game table structure of the present invention includes a ball game table 1 and a seat compartment 2.

Figure 1:
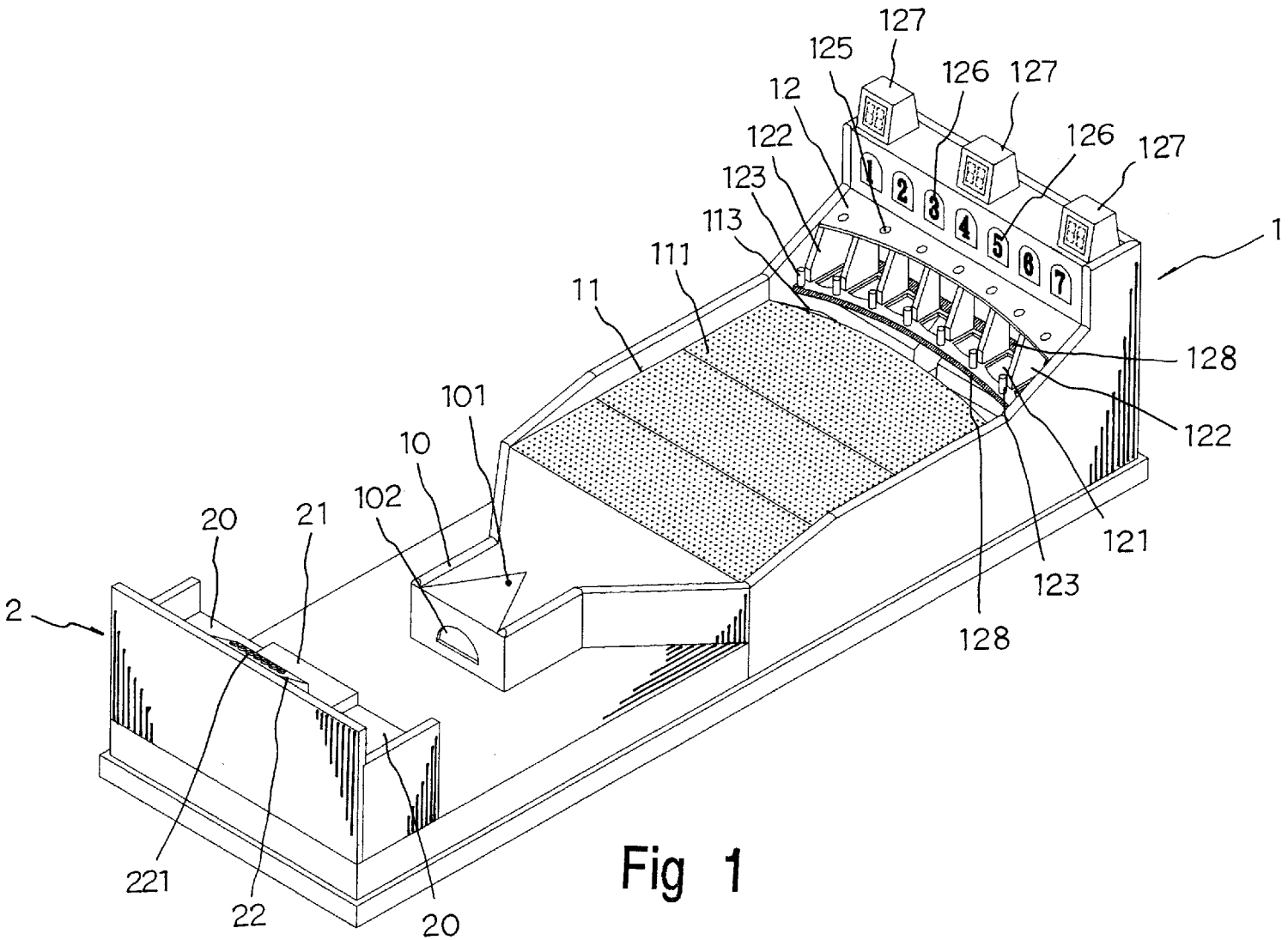
FIG. 1 is a perspective view of the present invention.
Figure 2:
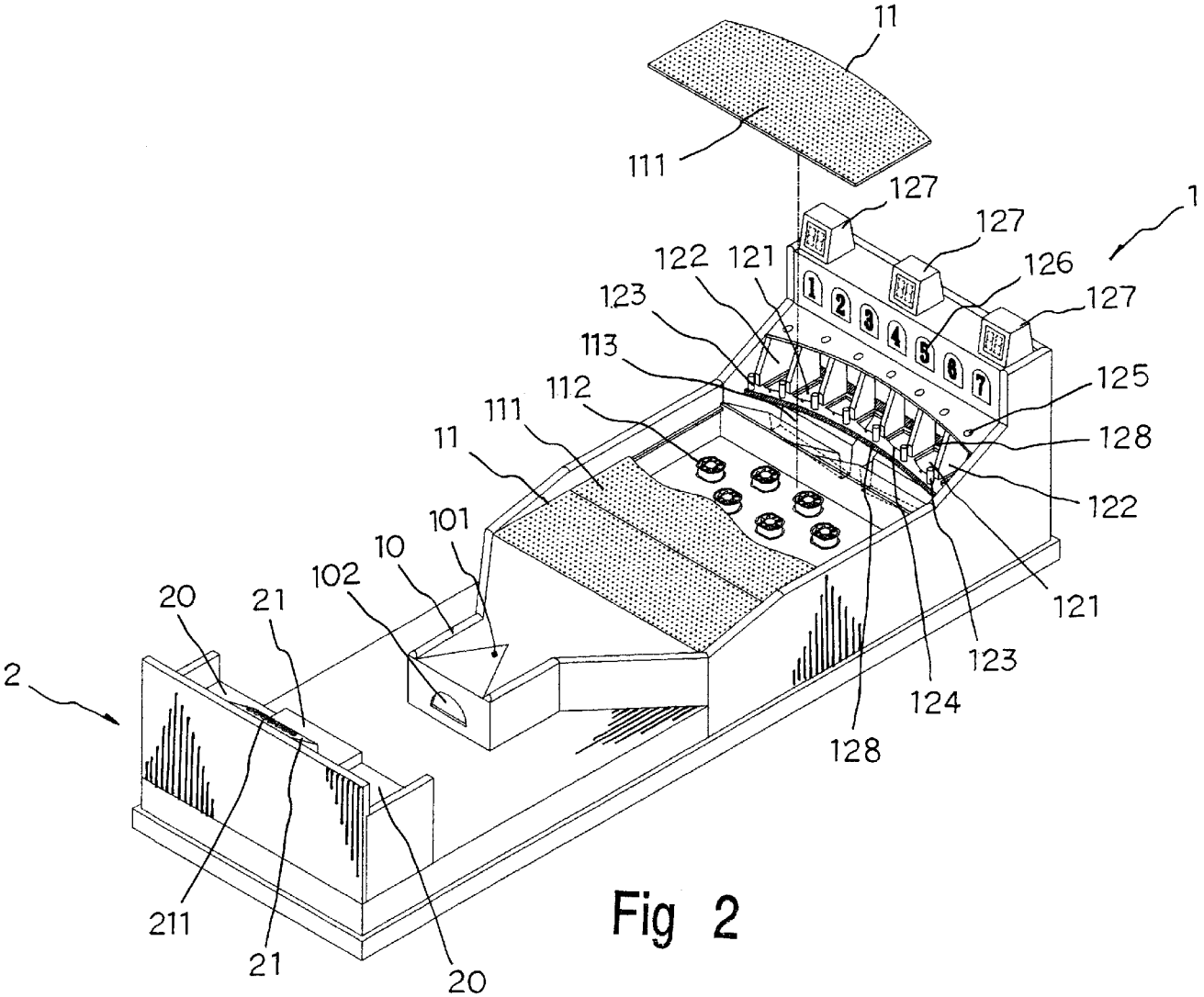
FIG. 2 is a partially sectional perspective view of the present invention.
Figure 3:
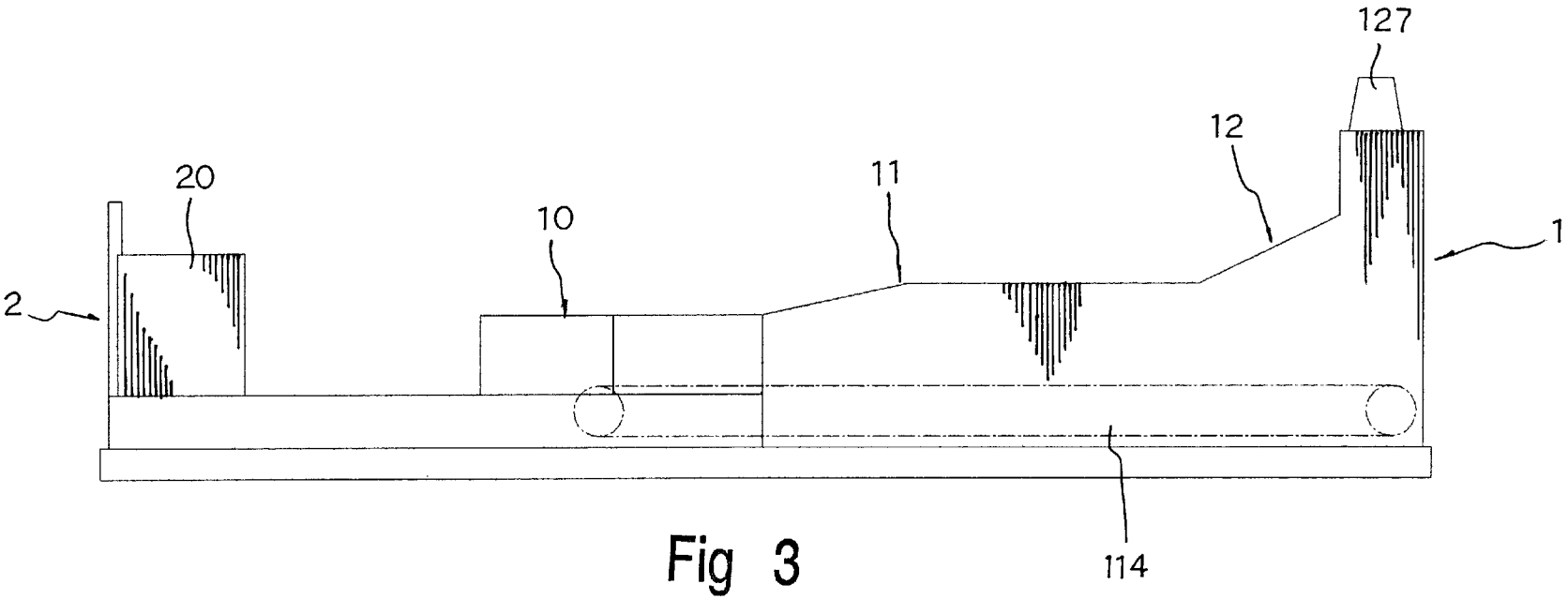
FIG. 3 is a side view of the present invention.
Figure 4:
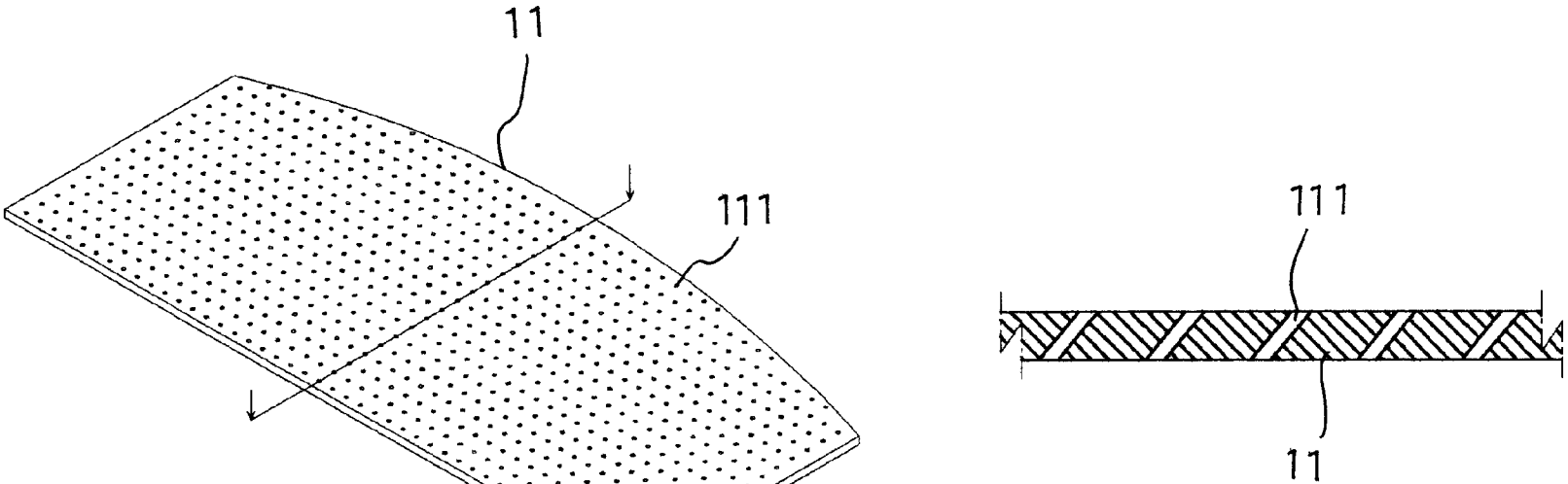
FIG. 4 is a sectional view showing the vents formed on the lane section of the present invention.
Figure 5:
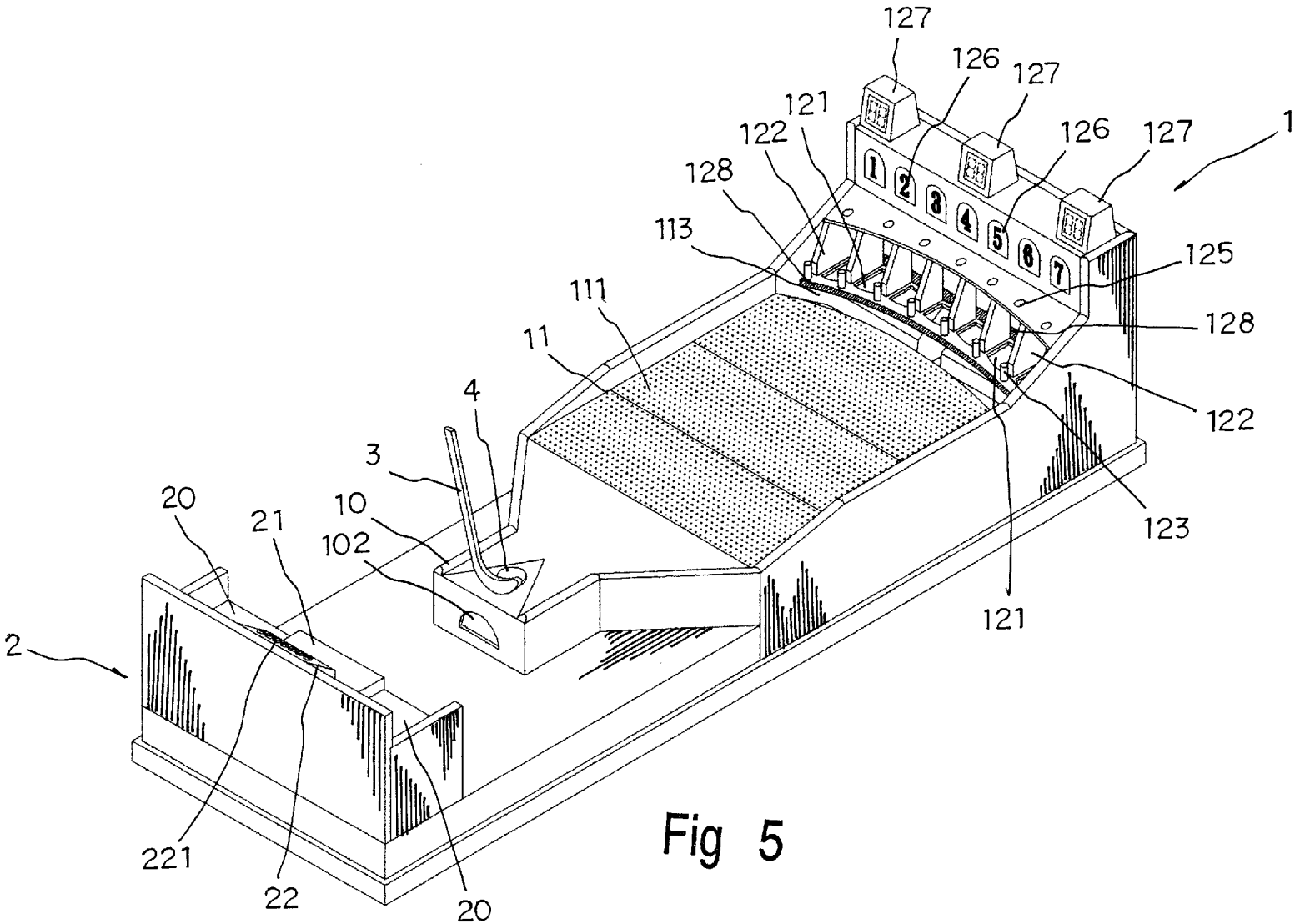
FIG. 5 is a perspective view showing the use of the present invention.

As shown in FIG. 1, the ball game table 1 is a long rectangular body including a converging serve section 10 at one end, a middle smooth lane section 11 and a pocket section 12 at the other end. A starting point 101 is disposed on the serve section 10. A cavity 102 is formed under the starting point 101. The surface of the lane section 11 is formed with multiple oblique fine vents 111 evenly distributed thereon as shown in FIG. 4. Several fans 112 are arranged in a close space of the bottom of the lane section 11 to provide necessary air floating force for the floating/dropping ball as shown in FIG. 2. A groove 113 is formed on an adjoining section between the lane section 11 and the pocket section 12. The groove 113 is inclined from two sides to the center and has a split at the center. A conveying belt 114 is positioned right under the groove 113 for conveying the ball dropping into the groove 113 to the cavity 102 of the serve section 10 as shown in FIGS. 2 and 3. The pocket section 12 has an arch pattern and has multiple independently partitioned dropping holes 121 corresponding to the entering angle of the ball. A bank pole 123 is disposed in front of the partitioning board 122 separating each two adjacent dropping holes 121. A sensor 124 is mounted on a side wall of each dropping hole 121. An LED flickering device 125 is disposed right above the sensor 124. A number flickering device 126 isdisposedonupper side of the LED flickering device 125 for marking the dropping hole 121. In addition, several scorers 127 are arranged on uppermost portion of the dropping section 12.

In addition, rubber cushions 128 are disposed on the inner peripheral wall and rear wall of each dropping hole 121 and on the front edge of the groove 113 for buffering the impacting force of the floating/dropping ball and achieving a protection effect.

As shown in FIG. 1, the seat compartment 2 includes two seats 20 and a middle table face 21. A cabinet (not shown) for placing personal stuffs therein is provided under each seat 20. A garbage can (not shown) is disposed under the table face 21 and a control panel 22 is disposed above the table face 21. The control panel 22 has multiple push buttons 221 providing functions of random selection of the dropping holes, scoring, clearing, etc. The control panel 22 is electrically connected to the flickering device 125 and the number flickering device 126 via wires conducted from the bottom face of the ball game table 1 to the pocket section 12.

Figure 6:
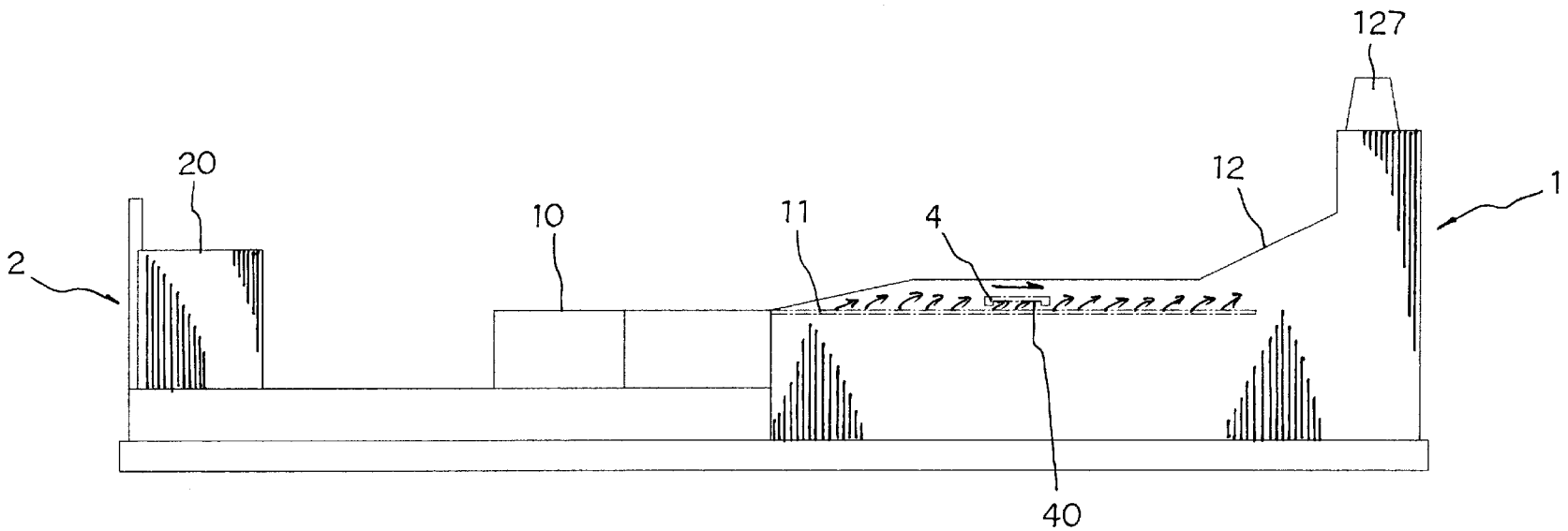
FIG. 6 is a side view showing that the floating/dropping ball slides over the lane section of the present invention by way of air floating.

In use of the floating/dropping ball game table of the present invention, as shown in FIG. 6, a club 3 with specific pattern is used in cooperation with the floating/dropping ball 4 to putt the ball. The club 3 is substantially L-shaped, while the floating/dropping ball 4 is a wooden flat circular body. The center of the bottom face of ball 4 is formed with a recess 40. Accordingly, when playing the game, a player can first press a push button 221 of the control panel 22 of the table face 21 to randomly light up a number flickering device 126 above the pocket section 12. According to the stop number, the player swings the club 3 to strike out the floating/dropping ball 4 placed on the starting point 101. Multiple fine vents 111 are distributed over the surface of the lane section 11 so that when the ball 4 slides over the lane section 11, the fans 112 thereunder will continuously blow wind out of the vents 111. Therefore, the ball 4 actually will not contact with the surface of the lane section 11 and will float in the air as shown in FIG. 6. Moreover, the vents 111 are inclined toward the pocket section 12 by 45 degrees so that the ball 4 will more smoothly slide without obstruction. In the case that the ball 4 successfully gets into the dropping hole 121 under the designated number, the sensor 124 on the side wall of the dropping hole 121 will detect the falling ball 4 and at the same time trigger the flickering device 125 to flicker. At this time, a cooperative audio effect will be also emitted and the scorer 127 will automatically score. In the case that the ball 4 is struck into another dropping hole 121 or falls into the groove 113, a regretful sound will be emitted. No matter whether the ball 4 gets into the correct dropping hole 121 or an incorrect one or falls into the groove 113, the ball 4 will roll toward the central split along the inclined groove 113 to directly fall from the split onto the conveying belt 114. The conveying belt 114 then conveys the ball 4 into the cavity 102 for the player to easily and conveniently take back the ball 4.

The above floating/dropping ball game table can be otherwise played as follows:

Counting times of striking: A player strikes the ball in sequence of the numbers of pockets. The number of times of using the club for striking the ball into each pocket are accumulated. Then the other player strikes the ball for getting into the same pocket. After all the pockets are finished, the total numbers of times of striking of both players are counted. The player with less number of times of striking is the winner.

No. 7 pocket: The player presses the push button to randomly decide the playing sequence of the players. The player starts to strike the ball into the pockets from the least number. In the case of scoring, the player can further strike the ball for the next number of pocket. In the case of failure or fault, the other player starts to strike the ball for the same pocket. The one who strikes the ball into the last pocket is the winner.

The rule of playing the game can be freely modified as desired to increase the difficulty and fun in the game and achieve a leisurely and entertaining effect.

According to the above arrangement, the floating/dropping ball game table structure of the present invention has the following features:

1. The structure is novel and fashionable and is combined with electronic and dynamic design to achieve an enhanced leisurely feeling.
2. The structure can be played according to versatile and funny game rules to avoid monotonous feeling of conventional device.
3. By means of the air floating principle, a player can easily and leisurely swing the club without consuming much strength. The cooperative electronic video and audio effect enhances the excitement in the game and achieves an admiring effect for the player. Also, the automatic ball returning design avoids the trouble of taking back the ball.

The above embodiments are only used to illustrate the present invention, not intended to limit the scope thereof. Many modifications of the above embodiments can be made without departing from the spirit of the present invention.

What is claimed is:

1. Floating/dropping ball game table structure comprising a ball game table and a seat compartment, said ball game table structure being characterized in that:

the ball game table including a serve section, a lane section and a pocket section, a starting point being disposed on the serve section for the floating/dropping ball to rest thereon, a cavity being formed under the starting point for receiving an automatically returning ball, the lane section having a polished plane surface on which multiple 45 degrees inclined fine vents are evenly distributed, several fans being arranged in a close space of the bottom of the lane section to provide necessary air floating force for the floating/dropping ball to slide over the lane section, a groove being formed on an adjoining section between the lane section and the pocket section, the pocket section having multiple independently partitioned dropping holes, multiple flickering devices and number flickering devices respectively corresponding to the dropping holes and scorers; and the seat compartment includes two seats and a table face positioned therebetween, a cabinet for placing personal stuffs therein being provided under each seat, a garbage can being disposed under the table face, a control panel being disposed above the table face, the control panel having multiple functional push buttons.

2. Floating/dropping ball game table structure as claimed in claim 1, wherein the groove is inclined from two sides to the center and has a split at the center, a conveying belt being positioned right under the groove for automatically returning the ball dropping into the groove to the cavity of the serve section.

3. Floating/dropping ball game table structure as claimed in claim 1, wherein rubber cushions are disposed on inner peripheral wall and rear wall of each dropping hole and on a front edge of the groove for buffering impacting force of the floating/dropping ball and achieving a protection effect.

* * * * *